US008221170B2

(12) United States Patent
Chen

(10) Patent No.: US 8,221,170 B2
(45) Date of Patent: Jul. 17, 2012

(54) ELECTRICAL CONNECTOR HAVING DEFORMABLE ENGAGING POST

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/905,124

(22) Filed: Oct. 15, 2010

(65) Prior Publication Data

US 2011/0244735 A1 Oct. 6, 2011

(30) Foreign Application Priority Data

Mar. 31, 2010 (CN) ..... 2010 2 0146634

(51) Int. Cl.
*H01R 13/514* (2006.01)

(52) U.S. Cl. ..... 439/731

(58) Field of Classification Search ..... 439/731, 439/465–467, 687, 696; 29/739, 841
See application file for complete search history.

(56) References Cited

U.S. PATENT DOCUMENTS

| | | | | |
|---|---|---|---|---|
| 3,756,115 | A * | 9/1973 | Schuplin | 411/508 |
| 4,173,387 | A * | 11/1979 | Zell | 439/557 |
| 4,205,889 | A * | 6/1980 | Rieman | 439/82 |
| 4,735,753 | A * | 4/1988 | Ackermann | 264/445 |
| 5,580,203 | A * | 12/1996 | Read et al. | 411/508 |
| 5,584,725 | A * | 12/1996 | Tseng et al. | 439/572 |
| 5,754,409 | A * | 5/1998 | Smith | 361/803 |
| 6,293,827 | B1 * | 9/2001 | Stokoe | 439/607.07 |
| 6,307,753 | B1 * | 10/2001 | Baginy et al. | 361/796 |

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector includes an insulative housing defining a base and a cover confronting with the base, and a plurality of contacts sandwiched between the base and the cover. The base defining at least one latching post to engaging with corresponding mating hole on the cover. The at least one post is a cone tubular with a diameter of a free end thereof larger than a diameter of a root thereof and the mating hole has a portion aligned with the free end which has a larger diameter than another portion thereof aligned with the root.

15 Claims, 5 Drawing Sheets

ELECTRICAL CONNECTOR HAVING DEFORMABLE ENGAGING POST

BACKGROUND OF THE INVENTION

1. Field of the Invention

The present invention relates to an electrical connector, and more particularly, to an electrical connector having deformable engaging post for readily engaging with a mating hole.

2. Description of the Prior Art

It is known to provide electrical connectors with means for securing the connector to a printed circuit board. One kind of boardlock is a snap latch for securing a connector block or housing to the printed circuit board. The snap latch is typically a molded plastic peg which is bifurcated to define a pair of resilient legs having latching barbs or hooks thereon. The legs, during insertion through a hole in the printed circuit board from a first side of the board, deflect inwardly toward the axis of the snap latch. As the hooks on the ends of the legs pass through the hole on the board, the legs bounce back outwardly into a position with shoulders on the hooks extending beyond the periphery of the hole and engaging a second side of the board, thereby securing the connector to the board.

An electrical connector disclosed in U.S. Pat. No. 5,378,172 issued to Roberts on Jan. 3, 1995 includes a latching post with two legs for mounting to a through-hole recess on a circuit board. As the legs pass through the recess on the board, the legs snap back outwardly into a position with shoulders on the hooks extending beyond the periphery of the hole and engaging a second side of the board, thereby securing the connector to the board. However, the legs will encounter a deformation while passing through the hole in the board, after bending over some extent in the space between two legs, the problem of breakage is particularly prevalent with the brittle plastic material which presently is used quite often in molding connector housings. And the molding process of the post with hook shoulders is also complicated.

In view of the above, an improved electrical connector that overcomes the above-mentioned disadvantages is desired.

SUMMARY OF THE INVENTION

Accordingly, an object of the present invention is to provide an electrical connector which has improved alignment and positioning structure for a post received therein.

To fulfill the above-mentioned object, an electrical connector comprises an insulative housing defining a base and a cover confronting with the base, and a plurality of contacts sandwiched between the base and the cover. The base defining at least one latching post to engaging with corresponding mating hole on the cover. The at least one post is a cone tubular with a diameter of a free end thereof larger than a diameter of a root thereof and the mating hole has a portion aligned with the free end which has a larger diameter than another portion thereof aligned with the root.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
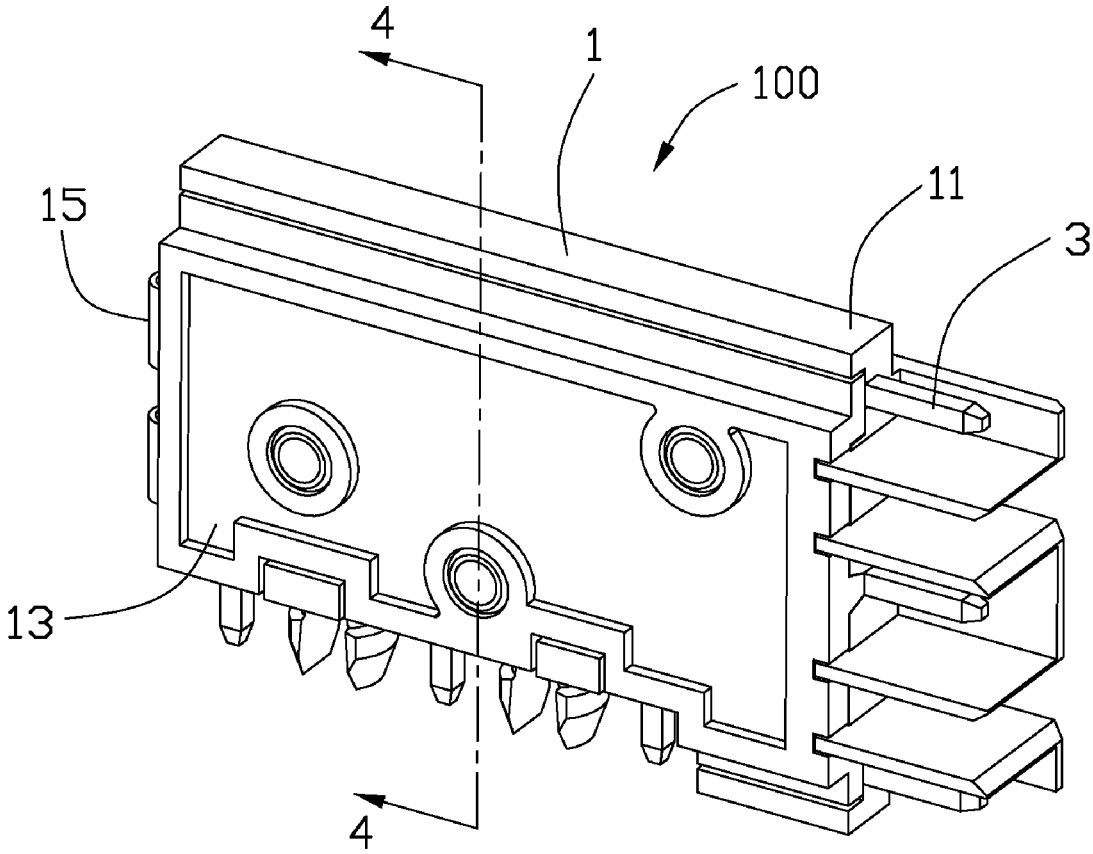
FIG. 1 is an assembled, perspective view of an electrical connector of an embodiment of the present invention.
Figure 2:
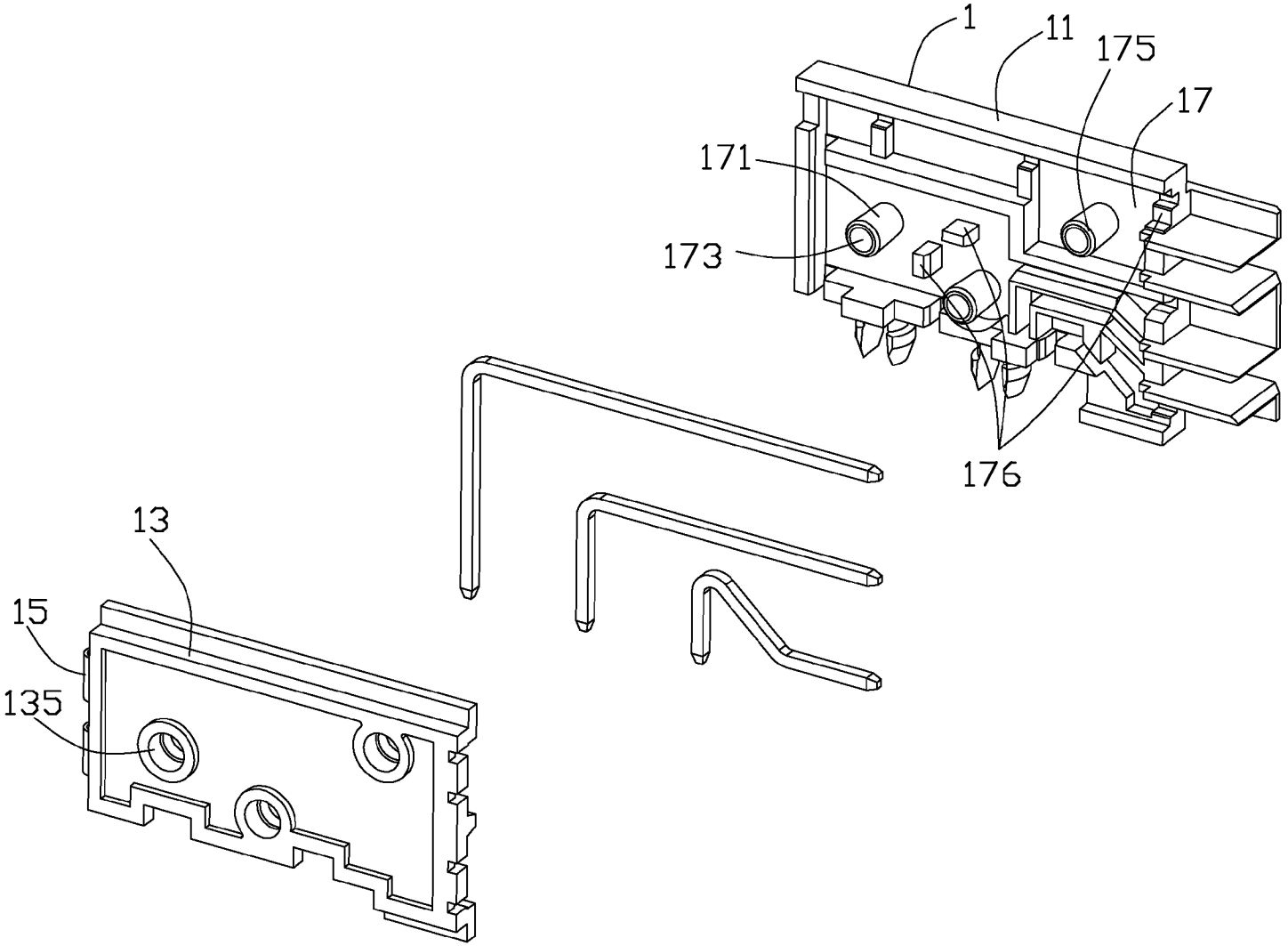
FIG. 2 is an exploded, perspective view of the electrical connector as shown in FIG. 1.

Referring to FIGS. 1 and 2 , an electrical connector 100 in accordance with the embodiment of the present invention comprises an insulative housing 1 and three pins 3 received in the housing. The insulative housing 1 comprises a base 11 or a first board with said pins 3 thereon, a cover 13 or a second board. The cover 13 revolves round a joint member 15 to shut with the base 11 and to fitly hold the pins 3 between the base and the cover. (For ease of presentation, the base and the cover are vertically separated in exploded view)

Figure 3:
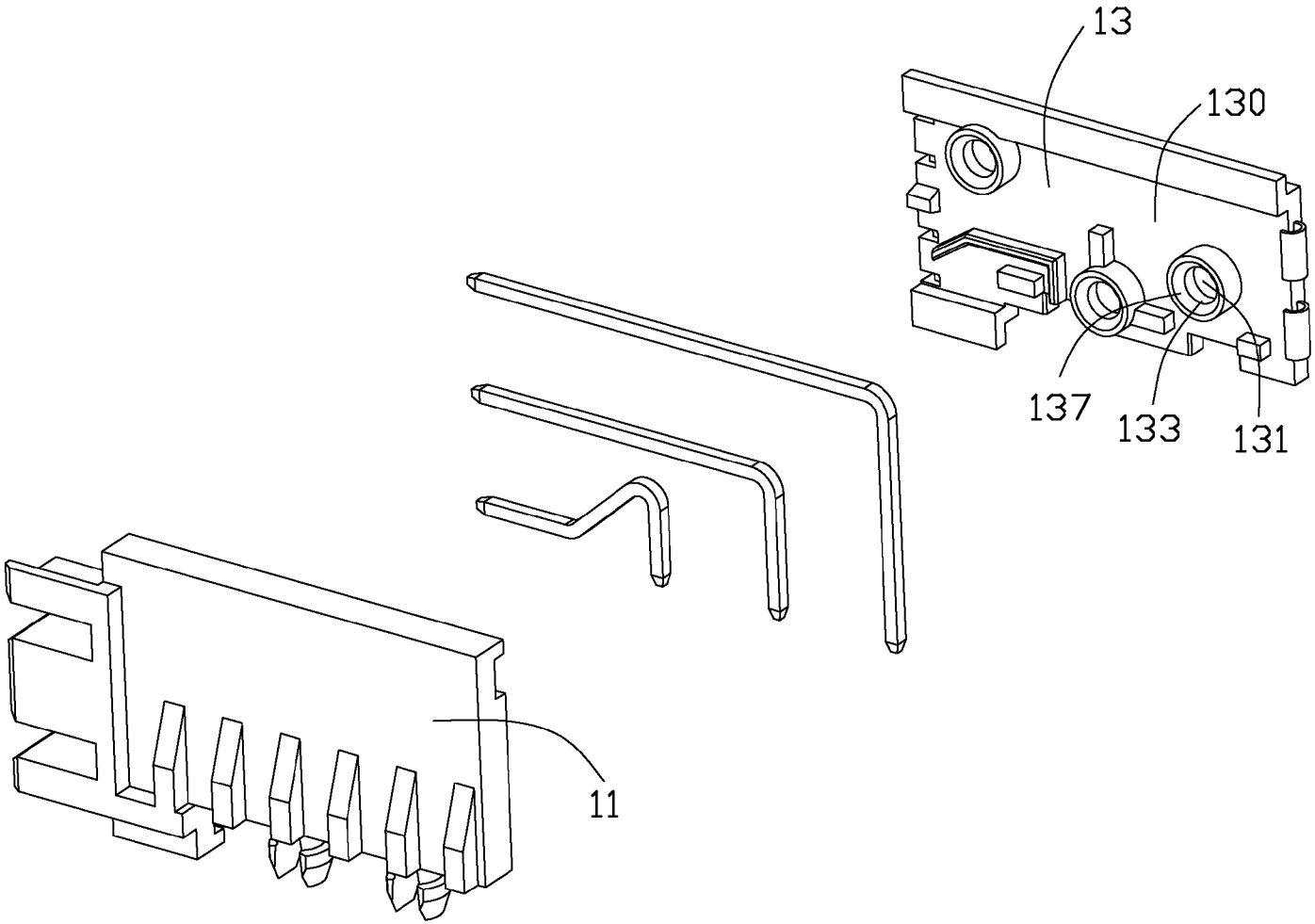
FIG. 3 is another exploded, perspective view of the electrical connector as shown in FIG. 1.
Figure 4:
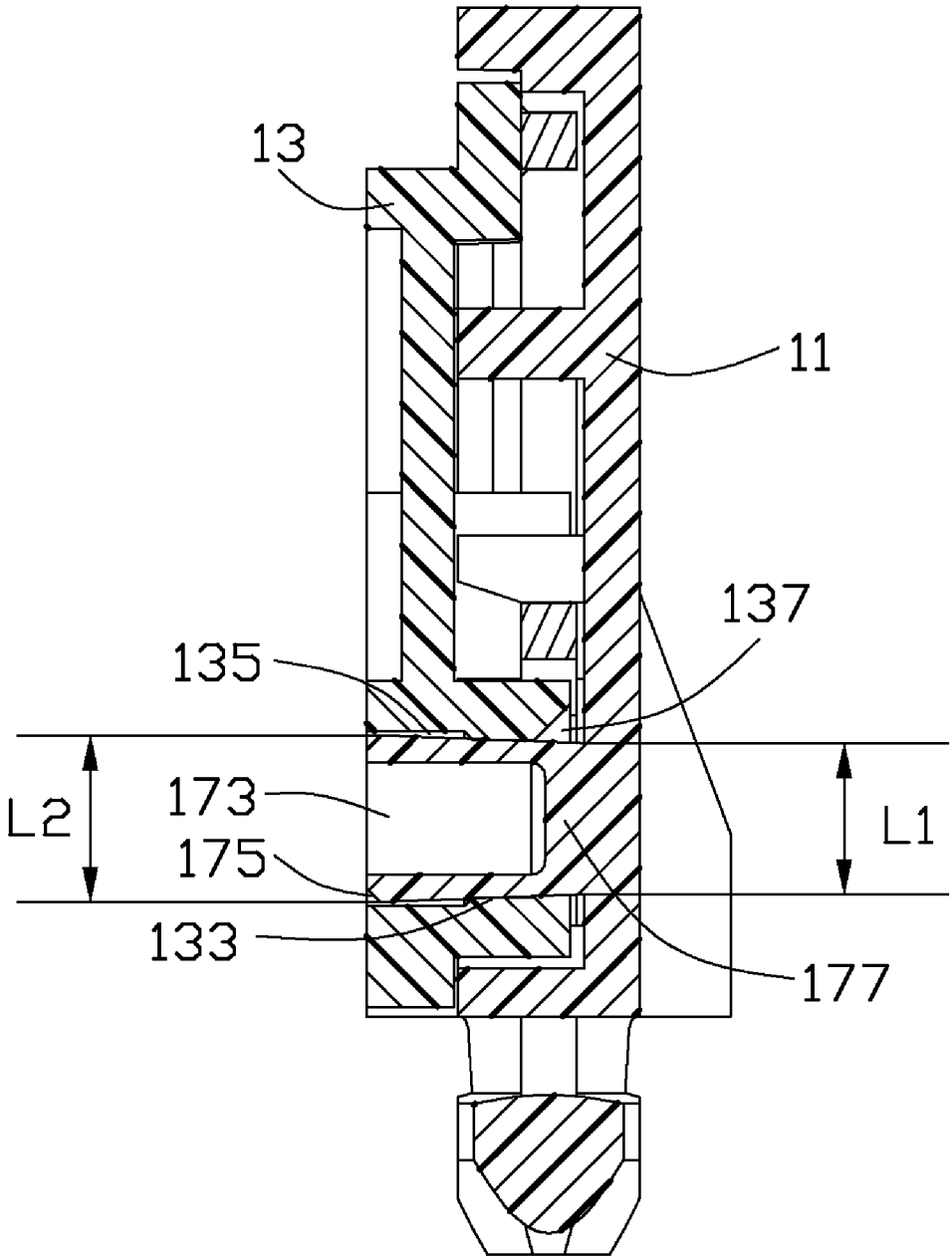
FIG. 4 is a cross section view along a line 4-4 in FIG. 1.

Referring to FIGS. 2 to 4, the base 11 defines a base surface 17 facing to the cover, positioning blocks 176 are protruded on the base surface and configured for arranging the pins 3 to the base. The base 11 further forms three latching posts 171 vertically projected from the base surface 17 for engaging with corresponding though holes 131 formed on the cover 13. As best shown in FIG. 4, the free end of each latching post 171 forms a chamfer 175 in the peripheral part and a blind hole 173 in the central part with a lower depth than the whole height of the post 171 to make the post 171 with a strong root 177 and continuous tubular. As a whole, the latching post 171 is a reversed cone with free end diameter L2 larger than root diameter L1.

Still referring to FIGS. 2 to 4, each of the though hole 131 on the cover 13 comprises a first hole 133 on a first surface 130 confronting with the base surface 17 and a second hole 135 on a second surface opposite to the first surface. As double step set for mating with the post 171, the first hole 133 has almost the same diameter as the root diameter L1 of the post and the second hole 135 has the same or a little larger diameter as the free end diameter L2 of the post. The peripheral part of the first hole 133 near to the base 1 side further forms a chamfer 137 for guiding the post.

Referring particularly to FIG. 4, this subsection provides a brief introduction to engage the base 11 and the cover 13. Firstly, press down on the cover to assure that the chamfer 137 of the first hole 133 is in proper alignment with the chamfer 175 of the post 171. Secondly, continue to press down on the cover to make the tubular part of the post 171 deform inwardly. Thirdly, after pass through the first hole 133, the tubular part is relaxed and freely received in the second hole 135, which cause the first hole latched between the base and the tubular part.

Figure 5:
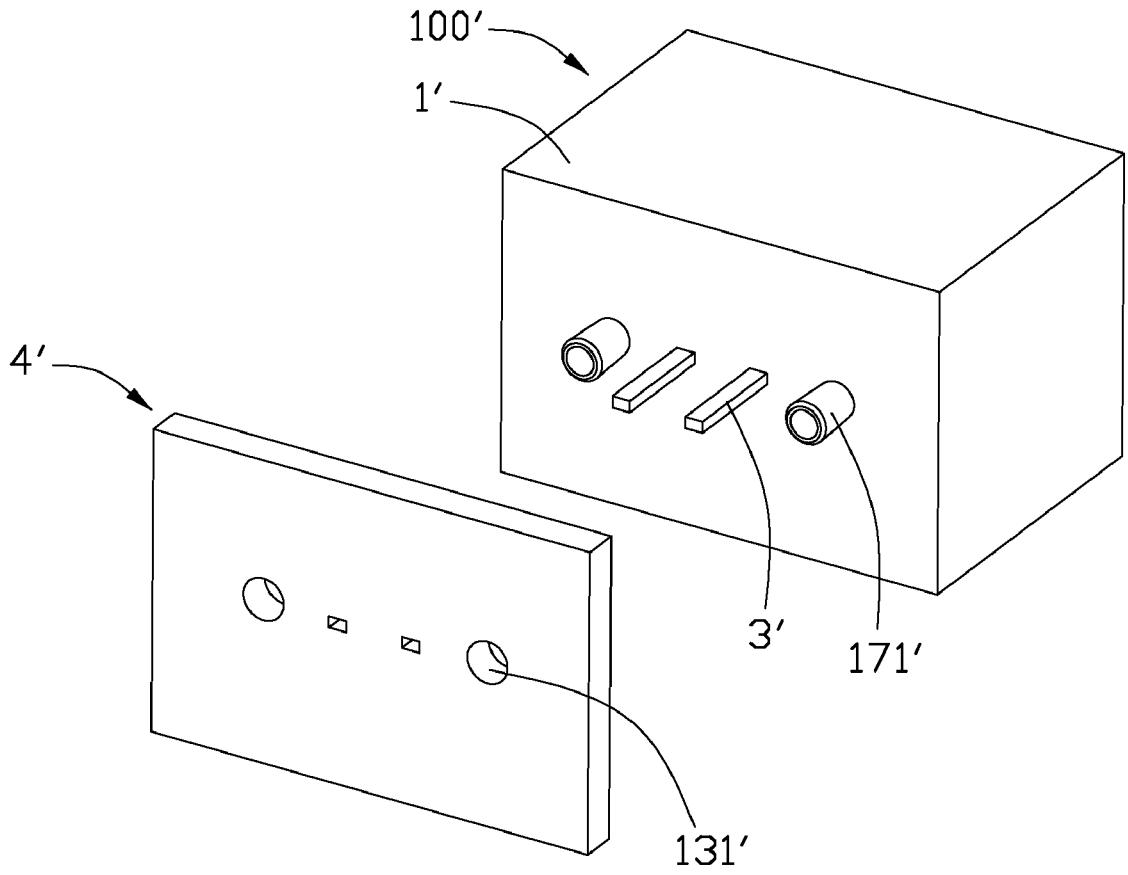
FIG. 5 is a perspective view of the electrical connector of another embodiment of the present invention.

Referring to FIG. 5, another exemplary embodiment is described. The latching post 171' can also be used with common hole. This embodiment discloses an electrical connector 100' for mounting to a circuit board 4' comprising an insulative housing 1' and two contacts 3' received in the housing, two reversed cone posts 171' are projected on a mounting face (not labeled) of the housing 1' for engaging with corresponding though holes 131' formed on the board 4'. The free end of each latching post 171' also forms a chamfer (not labeled) in the peripheral part and a blind hollow (not labeled) in the central part which can make the tubular part a certain flexibility. After pass through the hole 131', the tubular part can be relaxed and firmly locked with the board.

Generally speaking, because of the continuous tubular structure, external force can be diverted to the whole post and the tubular part can deform inwardly. And because of the reversed cone structure, the corresponding hole can be latched after the passing through the first hole. The chamfer on the post and the hole on the board are added for easily guiding the insertion and optimizing the latching effect. Also, the reversed cone with low oblique angle can be pulled out from the die directly without complicate mold design.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a base and a cover confronting with the base; and a plurality of contacts sandwiched between the base and the cover;

the base integrately defining at least one latching post to engage with corresponding mating hole defined on the cover; wherein the at least one latching post is a cone tubular with a diameter of a root thereof gently increasing to a largest diameter of a free end thereof and the mating hole has a portion aligned with the free end which has a larger diameter than another portion thereof aligned with the root, the distance between the root and the free end is greater than the largest diameter.

2. The electrical connector as claimed in claim 1, wherein the free end of the at least one latching post defines a chamfer in a peripheral part thereof.

3. The electrical connector as claimed in claim 2, wherein the free end of the at least one latching post defines a blind hole in a central part thereof with a lower depth than a whole height of the at least one latching post.

4. The electrical connector as claimed in claim 1, wherein the mating hole is a through hole comprising a first hole projecting from a first surface confronting with the base surface and a second hole on a second surface opposite to the first surface, the first hole has almost a same diameter as the root and the second hole has a same or a little larger diameter as the free end.

5. The electrical connector as claimed in claim 4, wherein a peripheral part of the first hole defines a chamfer for guiding the at least one latching post.

6. The electrical connector as claimed in claim 1, wherein a joint member is integrally formed with the base and the cover, the cover can revolves round the joint member to shut with the base.

7. The electrical connector as claimed in claim 1, wherein the latching post is an side-enclosed cone tubular.

8. The electrical connector as claimed in claim 1, wherein the diameter of the root linearly increases to the largest diameter of the free end with a low oblique angle.

9. An electrical connector, comprising:

an insulative housing defining a side-enclosed tubular post;

a plurality of contacts received in the insulative housing; wherein the tubular post is generally in a cone-shape inside with a widened free end of an outside thereof and linearly increasing to a largest diameter of the free end with a low oblique angle.

10. The electrical connector as claimed in claim 9, wherein a mating hole is formed on a board for engaging with the tubular post and the mating hole has a diameter smaller than that of the free end.

11. The electrical connector as claimed in claim 9, wherein the free end of the post defines a blind hole in a central part thereof with a lower depth than a whole height of the post.

12. The electrical connector as claimed in claim 9, wherein the free end of the tubular post forms a chamfer in an outside peripheral part.

13. An electrical connector comprising:

a first part housing defining opposite first inner and outer assembling faces with a plurality of tubular posts extending on the first inner assembling face;

a second part housing assembled with the fist part housing and defining opposite second inner and outer assembling faces with the first inner assembling face and the second inner assembling face confronting each other, a plurality of round tubes extending through both said second inner assembling face and said outer assembling face, and exposed upon both said second inner and outer assembling faces with first and second inner diameters thereof under condition that the first inner diameter is smaller than the second inner diameter; and a plurality of contacts and sandwiched between the first part housing and the second part housing; wherein the tubular posts extend into the corresponding round tubes, and a distal end of each of the tubular posts is intimately exposed unto the second outer assembling face while not extending beyond the second outer assembling face; wherein the tubular post defines a larger outer diametrical dimension around the distal end compared with a root end thereof in a slope manner.

14. The electrical connector as claimed in claim 13, wherein the tubular post increases a thickness dimension around the distal end to define the larger outer diametrical dimension while the round tube defines a stepped manner on an interior surface for compliance with the tubular post.

15. The electrical connector as claimed in claim 13, wherein the contacts are disposed along the first inner assembling face, and an axis of the tubular post extends perpendicular to said first inner assembling face.

* * * * *